US006045209A

United States Patent [19]

Imai

[11] Patent Number: 6,045,209

[45] Date of Patent: Apr. 4, 2000

[54] CIRCUIT FOR DRIVING INK-JET HEAD

[75] Inventor: Koji Imai, Nagoya, Japan

[73] Assignee: Brother Kogyo Kabushiki Kaisha, Nagoya, Japan

[21] Appl. No.: 08/899,790

[22] Filed: Jul. 24, 1997

[30] Foreign Application Priority Data

Aug. 20, 1996 [JP] Japan ..... 8-218268

[51] Int. Cl.[7] ..... B41J 2/045

[52] U.S. Cl. ..... 347/11; 347/71

[58] Field of Search ..... 347/9, 10, 11, 347/70, 71

[56] References Cited

U.S. PATENT DOCUMENTS 5,227,813 7/1993 Pies et al. ..... 347/71
5,422,664 6/1995 Stephany ..... 347/14
5,552,809 9/1996 Hosono et al. ..... 347/10
5,557,304 9/1996 Stortz ..... 347/15
5,818,483 10/1998 Mizutani ..... 347/72

*Primary Examiner*—John Barlow
*Assistant Examiner*—An Do
*Attorney, Agent, or Firm*—Oliff & Berridge, PLC

[57] ABSTRACT

A drive voltage is applied to an actuator between adjacent ink-jet channels so that the actuator is deformed to jet ink from one of the adjacent channels. Then, a drive voltage for jetting ink from the other channel is applied to the actuator so as to partially overlap the drive voltage for deforming the actuator, and thereby the actuator returns to its original state. A first protection diode D1 and a second protection diode D2 for protecting transistors from a reverse bias voltage are connected respectively in parallel with a first transistor Q1 and a second transistor Q2, which constitute a driving circuit for the actuator. The average rectified current $I_0$ used in the maximum rating of the protection diodes D1 and D2 satisfies $I_0 \geqq 2 \times E \times C' \times f$ (amps), and the peak current $I_{FM}$ used in the maximum rating satisfies $I_{FM} \geqq 2 \times (E - E_F)/(2 \times R + R_{ON})$ (amps).

14 Claims, 9 Drawing Sheets

CIRCUIT FOR DRIVING INK-JET HEAD

BACKGROUND OF THE INVENTION

1. Field of the Invention

This invention relates to a circuit for driving an ink-jet head, particularly to a circuit for sequentially driving adjacent channels at high speed. The ink-jet head includes ink-jet channels made in continuous shape, actuators provided between the channels to pressurize ink in the channels and a circuit for driving the ink-jet head. The circuit uses diodes to protect switching devices from a breakdown due to a reverse bias voltage.

2. Description of the Related Art

A well known circuit for driving an ink-jet head includes ink-jet channels made in a continuous shape, actuators consisting of pressure-producing devices provided in correspondence with the channels and electrodes for applying voltages to the pressure-producing devices. In such an ink-jet head, voltages are applied to the electrodes of the actuators. The actuators generate pressure variations inside the channels to jet ink from the channels.

FIG. 3 is a more detailed construction of the ink-jet head. The ink-jet head 1 is provided with a piezoelectric board 2 having channel walls 11A, 11B, 11C, 11D, 11E. The channel walls 11A–11E form pressure producing devices. A part of the channel walls 11A–11E is made by a piezoelectric material formed integrally with the channel wall and polarized in an upright direction. Referring to FIG. 5, a cover plate 3 is fastened on the top of the piezoelectric board 2 through an adhesive layer 4. The ink-jet head 1 is divided into the piezoelectric board 2, cover plate 3, which serves as the upper wall of the ink chambers, and channel walls 11A–11E so as to form a number of channels (for example, 64 channels) 8A, 8B, 8C, 8D, 8E, and 8F that supply ink ejected for printing.

The channels 8A–8F are made shallow near a rear end of the piezoelectric board 2. The cover plate 3 is provided with an ink supply port 21. The ink supply port 21 is connected to a manifold 22 formed in the cover plate 3. Ink cartridges (not illustrated) connect the manifold 22 through the ink supply port 21 to supply ink to the rear ends of the channels 8A–8F.

A nozzle plate 31 is fastened by an adhesive on the front of the piezoelectric board 2 and the cover plate 3. Nozzles 32 are formed in the nozzle plate 31 in correspondence with the channels 8A–8F.

On both sides of the channel walls 11A–11E of each of the channels 8A–8F, electrodes 13 are provided to generate drive fields substantially perpendicular to the polarized direction of the respective piezoelectric materials of the channel walls 11A–11E. Conductive patterns 42 corresponding to the respective channel walls 11A–11E are formed on a board 41. The conductive patterns 42 are connected to the respective electrodes 13 using wires 43 by wire bonding.

As shown in FIG. 4, a head driver 51 for controlling ink-jet driving is connected to the conductive patterns 42. A control signal enters the head driver 51 through a line 53. A power supply voltage V is applied to the head driver 51 through a line 54, and a line 55 is provided for grounding. FIGS. 5 and 6 show the channels 8A–8F, the channel walls 11A–11E interposed between the channels 8A–8F, and electrodes 13A1, 13A2, 13B1, 13B2, 13C1, 13C2, 13D1, 13D2, 13E1, 13E2, 13F1, and 13F2 provided in correspondence with the channels 8A–8F, respectively. FIG. 5 is a longitudinal sectional view of the ink-jet head 1 showing a state with no voltage applied to the electrodes 13A1–13F2. FIG. 6 is a longitudinal sectional view of the ink-jet head 1 showing a state with a specific ON voltage applied to the electrodes 13C1 and 13C2.

Next, the ink jet motion by the ink-jet head 1 will be briefly described. Applying a specific ON voltage to the electrodes 13C1 and 13C2 and grounding the electrodes 13B2 and 13D1 will deform the channel walls 11B and 11C, as shown in FIG. 5 and FIG. 6, according to the piezoelectric perpendicular slip effect. The volume of the channel then varies to pressurize and jet the ink in the channel 8C.

FIG. 7 is a circuit diagram showing a connection of an equivalent circuit and a driving circuit for the foregoing ink-jet head. The adjacent electrodes 13A2 and 13B1 and the channel wall 11A interposed between the two adjacent electrodes 13A2 and 13B1 form an electrostatic capacitor $C_1$ (condenser). Similarly, electrostatic capacitors $C_1$–$C_5$ are formed by the adjacent electrodes 13B2 and 13C1 and the channel wall 11B, the adjacent electrodes 13C2 and 13D1 and the channel wall 11C, the adjacent electrodes 13D2 and 13E1 and the channel wall 11D, and the adjacent electrodes 13E2 and 13F1 and the channel wall 11E, respectively. Driving circuits 14A–14F are connected to electrode pairs 13Al and 13A2–13F1 and 13F2, respectively. The capacitance of electrostatic capacitors $C_1$–$C_5$ are all equal to C' (farads).

Next, the electric configuration of the driving circuits and the electrodes will be explained in detail with reference to FIG. 8. In the driving circuit 14C, two switching devices, a transistor Q1 and a transistor Q2 are connected in series between a power supply V (voltage E (volts)) and a ground. One terminal of a resistor R1 (resistance R(Ω)) is connected to a connection point P1 made by the transistor Q1 and the transistor Q2, and another terminal of the resistor R1 is connected to the electrodes 13C1 and 13C2. The transistor Q1 serves to raise a voltage applied to the electrodes 13C1 and 13C2 (for charging), and the transistor Q2 serves to lower the voltage (for discharging). Base ON currents are selectively applied from a controller (not shown) to bases B1 and B2 of the transistor Q1 and the transistor Q2, respectively, to turn one transistor ON/OFF while the other transistor is OFF/ON.

In the driving circuit 14B, two switching devices, a transistor Q3 and a transistor Q4 are connected in series between the power supply V (voltage E(volts)) and the ground. One terminal of a resistor R2 (resistance R(Ω)) is connected to a connection point P2 made by the transistor Q3 and the transistor Q4, and another terminal of the resistor R2 is connected to the electrodes 13B1 and 13B2. The transistor Q3 serves to raise a voltage applied to the electrodes 13B1 and 13B2 (for charging), and the transistor Q4 serves to lower the voltage (for discharging).

In the driving circuit 14D, two switching devices, a transistor Q5 and a transistor Q6 are connected in series between the power supply V (voltage E(volts)) and the ground. One terminal of a resistor R3 (resistance R(Ω)) is connected to a connection point P3 made by the transistor Q5 and the transistor Q6, and another terminal of the resistor R3 is connected to the electrodes 13D1 and 13D2. The transistor Q5 serves to raise a voltage applied to the electrodes 13D1 and 13D2 (for charging), and the transistor Q6 serves to lower the voltage (for discharging).

When the base ON current is applied to the base B1 of the transistor Q1 from the controller (the transistor Q2 is OFF) in order to drive the ink-jet head 1 to which the electrostatic capacitors $C_1$–$C_5$ are connected, a collector current Iq1 runs through the transistor Q1. The potential at the point B1 connected to the collector C1 of the transistor Q1 through the resistor R1 increases to a "H" level (E(volts)) and the potential E (volts) is applied to the electrodes 13C1 and 13C2. Accordingly, as shown in FIG. 6, channel walls 11B and 11C are deformed toward the channel 8C and pressurize ink to jet it. When the transistor Q1 is turned OFF, and the ON current is input to the base B2 of the transistor Q2, the voltage applied decreases to a "L" level (0(volts)). Then, a voltage is applied to the electrodes of the channel from which ink is to be jetted next.

When the adjacent channels 8C and 8D, for example, which share the channel wall 11C therebetween, are sequentially driven, until the walls of the first channel return to their straightened state, the walls of the second channel cannot deform. Therefore, the ink-jet interval depends on a cycle time in which the channel wall is mechanically deformed, straightened, and deformed.

SUMMARY OF THE INVENTION

In view of the foregoing, an object of the invention is to provide a circuit for driving adjacent channels sequentially at high speed and to provide a circuit for driving an ink-jet head in which switching devices such as transistors are protected from a breakdown due to a reverse bias voltage applied to the switching devices.

In the circuit for driving the ink-jet head, which includes ink-jet channels made in a continuous shape with actuators provided between the channels to pressurize the ink in the channels, when the ink is jetted sequentially from adjacent channels, a drive voltage is applied to the actuator between the adjacent channels. The voltage causes the actuator to deform to pressurize ink in one of the adjacent channels. A drive voltage is then applied to the actuator to return the actuator to its original state and to pressurize the ink in the other adjacent channel.

Accordingly, after the actuator between the adjacent channels is driven to jet ink from one of the adjacent channels, ink is jetted from the other adjacent channel by the use of the returning action of the actuator. Thus, the ink-jet interval is shortened.

According to another aspect of the invention, the actuators may be the channel walls. This allows the ink-jet head to be constructed without extra actuators provided in the channels.

According to still another aspect of the invention, the driving circuit may apply a drive voltage to the channel walls on both sides of the channel from which ink is to be jetted, and the ink in the channel may be pressurized from the channel walls on both sides of the channel. Accordingly, a high jetting pressure can be applied to the ink. In addition, when the adjacent channels are sequentially driven, the ink is pressurized by both the returning action of one channel wall and the deforming action of the opposite channel wall. However, when the adjacent channels are not sequentially driven, erroneous ink jetting is prevented when the channel wall returns to its original state.

According to still another aspect of the invention, at least one part of each channel wall is preferably formed from a polarized piezoelectric material. An electrode is preferably provided on either channel-facing side of the piezoelectric material to generate drive fields perpendicular to the polarized direction. This simplifies the construction of the ink-jet head.

According to still another aspect of the invention, the ink-jet driving circuit may operate as follows. The driving circuit applies a drive voltage for a given duration for jetting ink from a first one of adjacent channels. Then the driving circuit starts applying a drive voltage for jetting ink from a second adjacent channel in such a manner that a latter half of the drive voltage applying duration for the first one of the adjacent channels overlaps the drive voltage applying duration for the second adjacent channel. With this driving circuit, after the channel wall deforms to jet ink from one of the adjacent channels through the application of a voltage to the electrode on one side of the channel wall, and while the above voltage is still applied, if a voltage is applied to the electrode on the other side of the channel wall (i.e., the same voltage is applied to both sides of the channel wall), the channel wall returns to its original straightened state.

According to still another aspect of the invention, the ink-jet driving circuit is preferably arranged as follows. Two switching devices are connected in series between a power supply and a ground. A connection point made by the two switching devices is connected to the electrodes so that one of the two switching devices serves to raise the voltage applied to the electrodes and the other switching device serves to lower the voltage applied thereto. Protection diodes for protecting the switching devices from a reverse bias voltage are connected in parallel with the respective switching devices. An average rectified current $I_0$ used in the maximum rating of the protection diodes satisfies the following equation:

$$I_0 \geqq E \times C' \times f \times 2 \text{ (amps)},$$

where,

E: power supply voltage (volts)

C': electrostatic capacitance of the pressure-producing device (channel wall) (farads)

f: maximum printing frequency (Hz).

With this arrangement, the protection diodes can protect the switching devices from being affected by an excessive reverse bias voltage, and accordingly from breaking down. Since the maximum rating of the protection diodes is satisfied by the above requirement, the protection diodes may also be protected from breaking down.

According to still another aspect of the invention, the channels may be divided into groups so that adjacent channels belong to different groups, and the drive voltage may be applied group by group. The adjacent channels, if not arranged in groups, cannot be driven sequentially because the actuators return to their original state after one of the adjacent channels is driven and then the other adjacent channel is driven. If the adjacent channels are arranged in groups, all the channels can be driven sequentially.

According to still another aspect of the invention, the circuit for driving the ink-jet head may be arranged as follows. The ink-jet head includes ink-jet channels made in a continuous shape, actuators consisting of pressure-producing devices provided in correspondence with the channels, electrodes for applying a voltage to the pressure-producing devices and nozzles in correspondence with the channels. The ink-jet head generates pressure variations inside the channels to jet ink from the nozzles when a voltage is applied to the electrodes. In the ink-jet head driving circuit, two switching devices are connected in series between a power supply and a ground. A connection point made by the two switching devices is connected to the electrodes so that one of the two switching devices serves to raise a voltage applied to the electrodes and the other switching device serves to lower a voltage applied thereto. Protection diodes for protecting the switching devices from a reverse bias voltage are connected in parallel with the respective switching devices. An average rectified current $I_0$ used in the maximum rating of the protection diodes satisfies the following formula:

$$I_0 \geqq E \times C' \times f \times 2 \text{ (amps)},$$

where,

E: power supply voltage (volts)

C': electrostatic capacitance of the pressure-producing device (channel wall) (farads)

f: maximum printing frequency (Hz).

With this arrangement, the protection diodes can protect the switching devices from being affected by an excessive reverse bias voltage, and accordingly from breaking down. Since the maximum rating of the protection diodes is satisfied by the above requirement, the protection diodes can also be protected from breaking down.

According to still another aspect of the invention, a peak current $I_{FM}$ used in the maximum rating of the protection diodes preferably satisfies the following formula:

$$I_{FM} > 2(E - E_F)/(2 \times R + R_{ON}) \text{ (amps)}$$

where,

E: power supply voltage (volts)

$E_F$: forward voltage drop of the protection diode (volts)

R: resistance of an impedance of the circuit from the connection point made by the protection diodes to the electrodes (Ω)

$R_{ON}$: ON resistance of transistor (Ω).

Accordingly, the breakdown protection effect of the protection diodes is enhanced.

According to still another aspect of the invention, the circuit for driving the ink-jet head is preferably arranged as follows. The channels are formed dividedly in a continuous shape on a piezoelectric board. The channel walls provided with the electrodes constitute the pressure-producing devices. Deformation of the channel walls through the application of a voltage to the electrodes changes the channel volume, and ink is jetted.

BRIEF DESCRIPTION OF THE DRAWINGS

A preferred embodiment of the present invention will be described in detail with reference to the following figures wherein like reference numerals refer to like elements and wherein.

DETAILED DESCRIPTION OF THE PREFERRED EMBODIMENT

A preferred embodiment of the invention will hereafter be described in detail with reference to the accompanying drawings.

The ink-jet head includes channels made in a continuous shape, actuators consisting of pressure-producing devices provided in correspondence with the channels, electrodes that apply voltages to the pressure-producing devices and nozzles in correspondence with the channels. The ink-jet head generates pressure variations inside the channels to jet ink from the nozzles when a voltage is applied to the electrodes.

Figure 1:
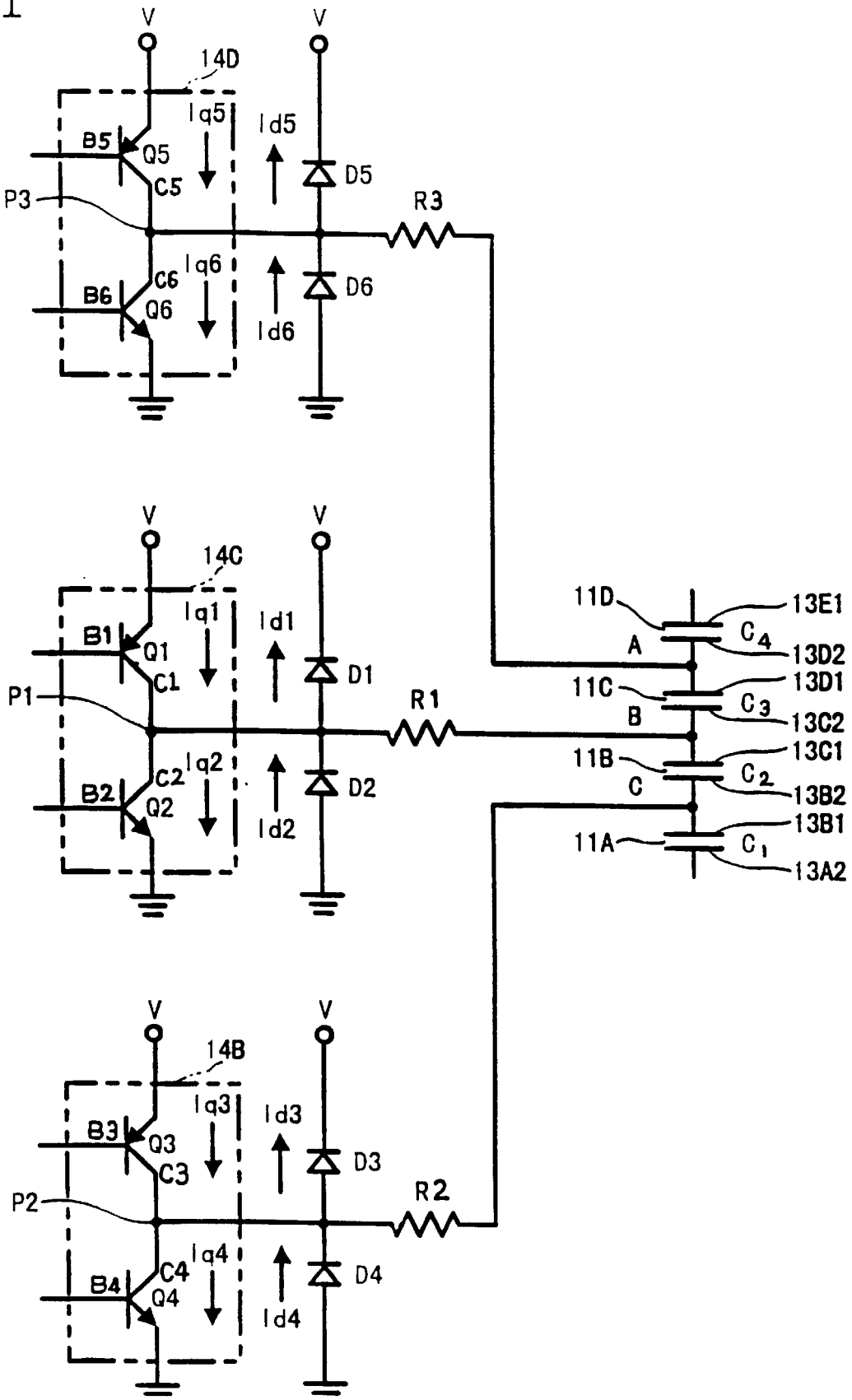
FIG. 1 shows a circuit for driving the ink-jet head relating to the invention.
Figure 5:
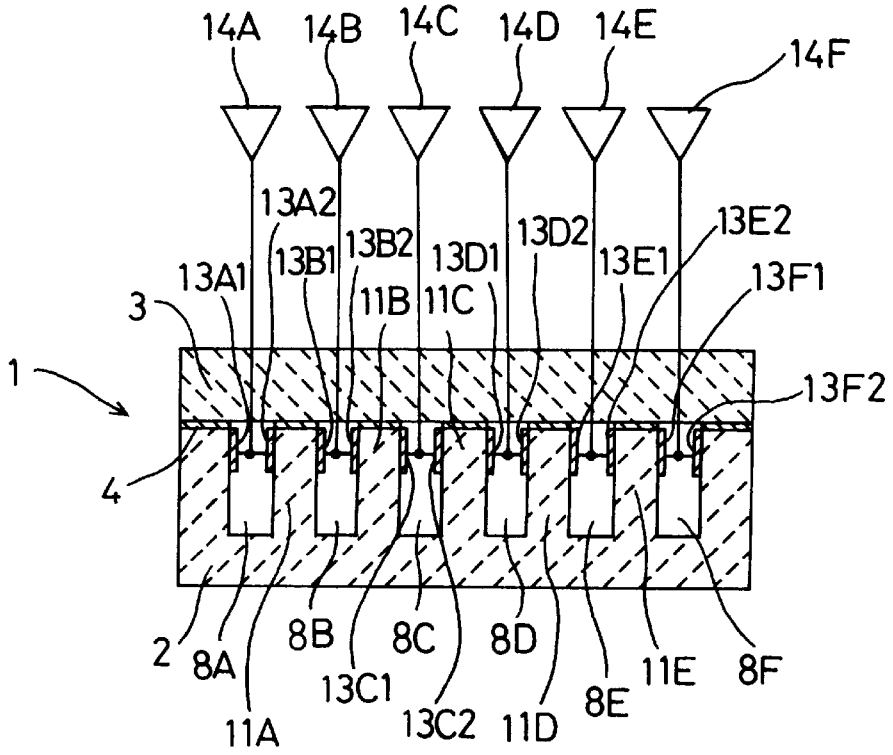
Fig.5 RELATED ART
FIG. 5 is a sectional view of the ink-jet head.
Figure 6:
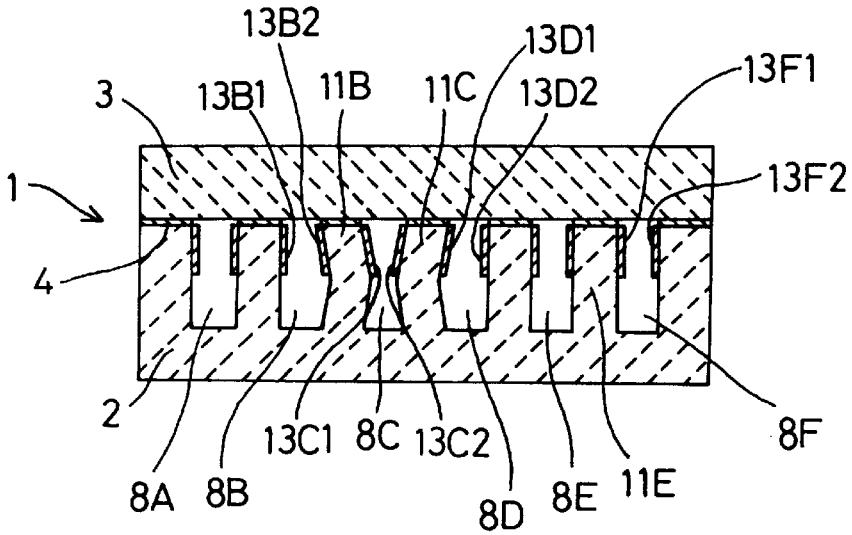
Fig.6 RELATED ART
FIG. 6 is a sectional view in which the ink-jet head in FIG. 5 is actuated.
Figure 7:
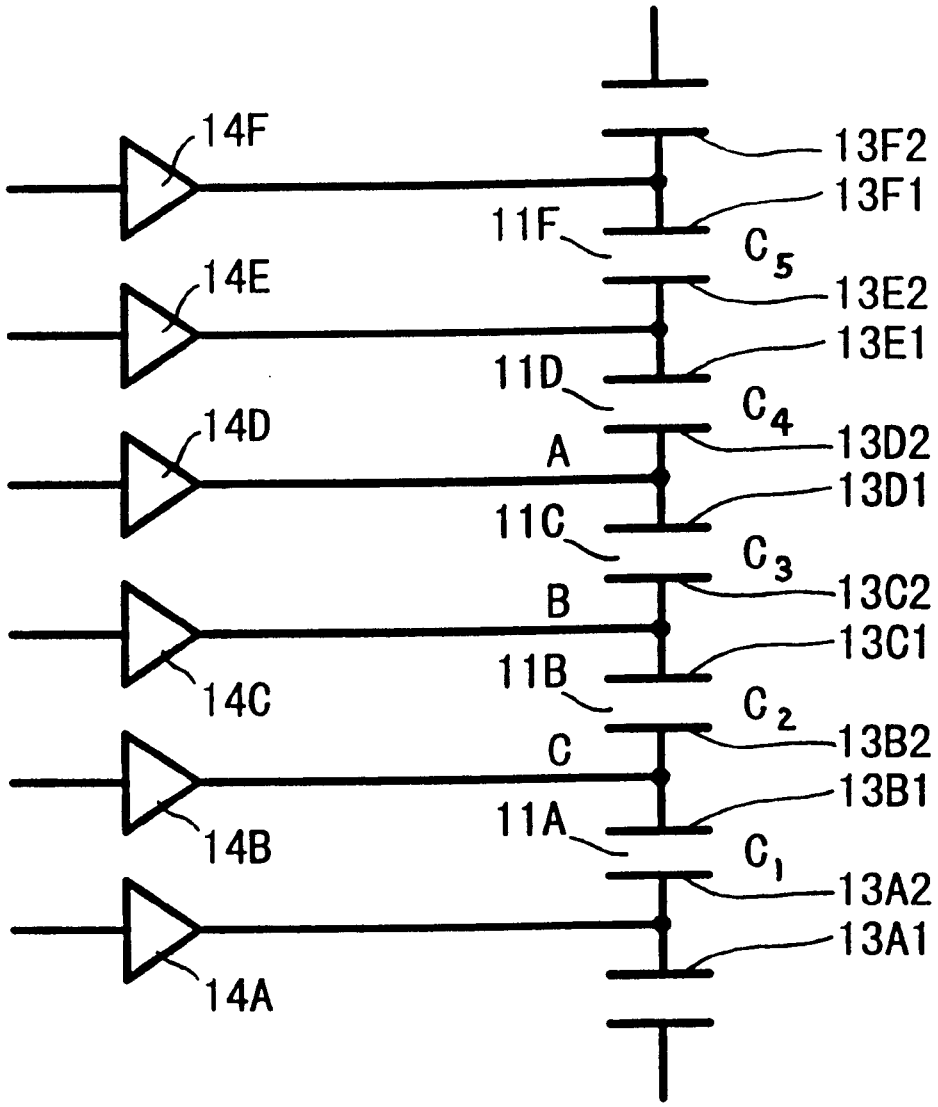
Fig.7 RELATED ART
FIG. 7 is an equivalent circuit for the ink-jet head.
Figure 10:
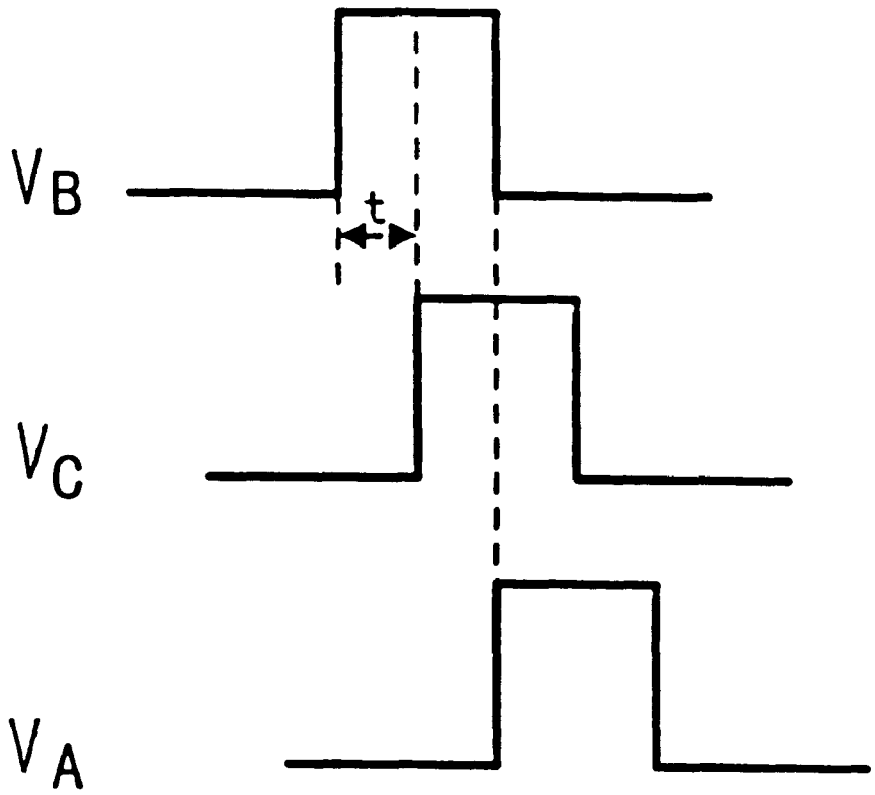
FIG. 10 shows the driving timing for the ink-jet head of the invention.
Figure 11A:
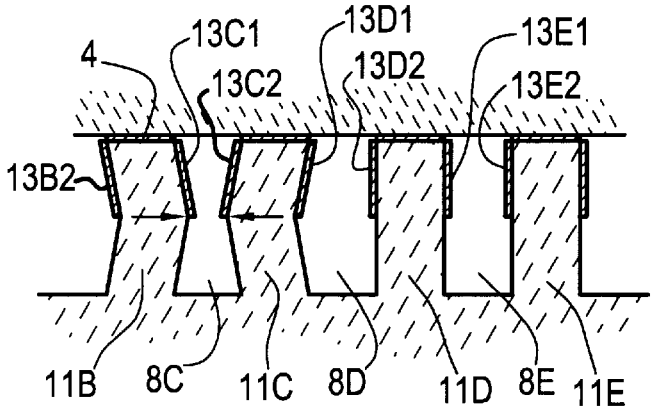
FIGS. 11(A), 11(B), and 11(C) are sectional view in which the ink-jet head in FIG. 5 is actuated.
Figure 11B:
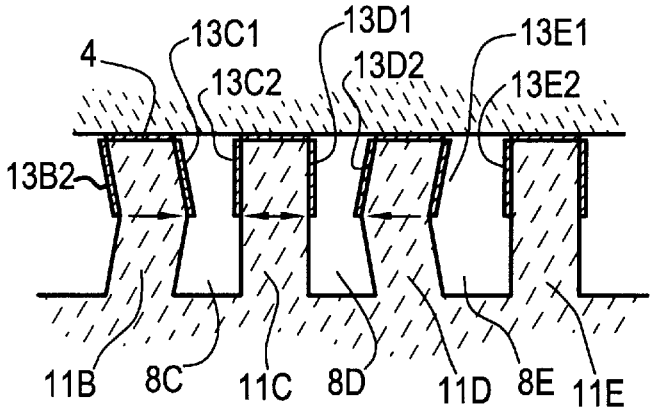

In a preferred embodiment of the invention, a driving circuit 14C shown in FIG. 1 applies a specific ON voltage ($V_B$ in FIG. 10) for a specific voltage applying duration to electrodes 13C1 and 13C2 and brings electrodes 13B2 and 13D1 into a grounded state. Channel walls 11B and 11C deform (responsive to the polarizing bias) as indicated by the shown arrows, due to the piezoelectric perpendicular slip effect, to project their central parts toward the channel 8C, as shown in FIGS. 5, 6 and 11(A). In this way, the channel walls 11B and 11C pressurize ink in the channel 8C to jet the ink. When ink is to be jetted from the channel 8D adjacent to the channel 8C, a voltage $V_c$, shown in FIG. 10, is applied to electrodes 13D1 and 13D2 of the channel 8D during the latter half of the voltage $V_B$ applying duration (i.e., at time t after the voltage $V_B$ is raised), as shown in FIG. 10. As a result, the voltage $V_c$ is applied to the channel wall 11C from the electrodes 13C2 and 13D1 provided on both sides thereof, and the channel wall 11C returns to its straightened state, as shown in FIG. 11(B). At the same time, the other channel wall 11D of the channel 8D is deformed toward the inside of the channel 8D by the voltage applied to the electrode 13D2. Accordingly, the ink in the channel 8D is pressurized from both sides by the straightened channel wall 11C and the channel wall 11D deformed toward the inside of the channel, and the ink is jetted at high pressure.

Figure 11C:
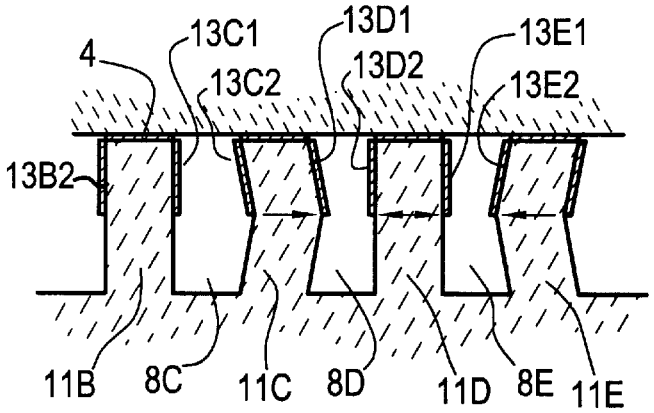

Likewise, by applying a voltage $V_A$ to the channel 8E adjacent to the channel 8D so as to partially overlap the voltage $V_C$ applying duration, the ink in the channel 8E can be jetted as shown in FIG. 11(C).

When the voltage reaches the "L" level (0(volts)), the channel wall 11B, for example, returns to its straightened state and the ink in the channel 8B, which is not to be jetted, is pressurized slightly. However, the channel is arranged so as not to jet the ink when the ink is pressurized from only one side.

With the above construction, it is impossible to jet ink from adjacent channels at the same time. Therefore, to allow the ink to be jetted from adjacent channels simultaneously, the channels are driven while they are divided into groups, with adjacent channels belonging to different groups. For example, six channels are divided, every two channels, into three groups. The driving circuit drives the group to which the channels 8B and 8E belong, the group to which the channel 8C and 8F belong, and the group to which the channels 8A and 8D belong at the above-mentioned ink-jet intervals of t staggered as shown in FIG. 10. Accordingly, if all the channels in one group return to their straightened state simultaneously, channels in the other groups are pressurized from only one side, causing no erroneous ink jetting.

Through the use of deformation of the channel wall between the adjacent channels and its returning action, as described above, ink can be jetted sequentially from two adjacent channels, resulting in a shorter ink-jet interval. Since the channels in different groups can be driven independently of each other, the recording speed of the ink-jet head 1, which is determined by the above-mentioned ink-jet interval, is increased. Additionally, channels are arranged in a high density pattern with no extra space and only one channel wall between the adjacent channels, thereby allowing high density recording.

Figure 8:
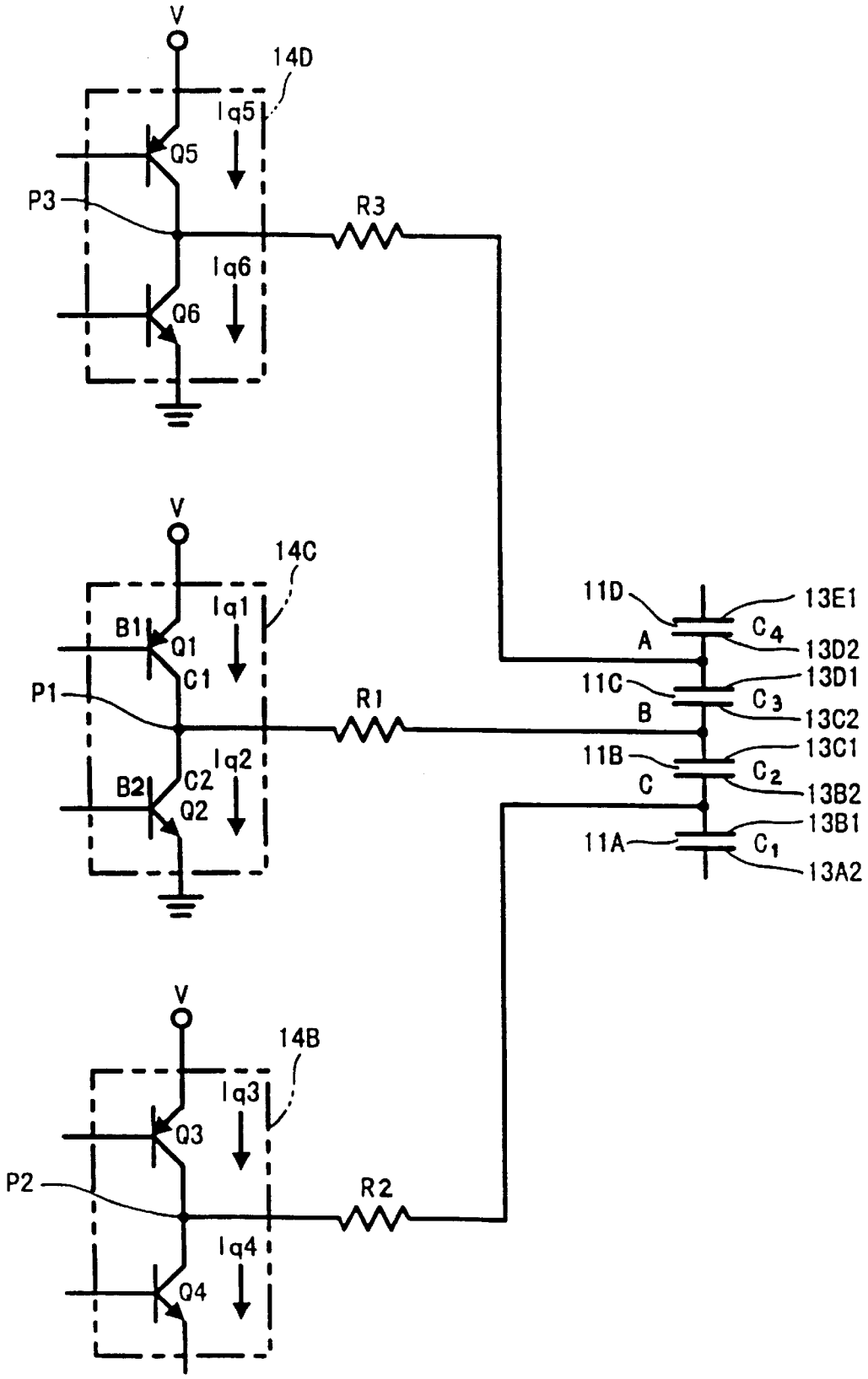
Fig.8 RELATED ART
FIG. 8 is a conventional circuit for driving the ink-jet head.
Figure 9B:
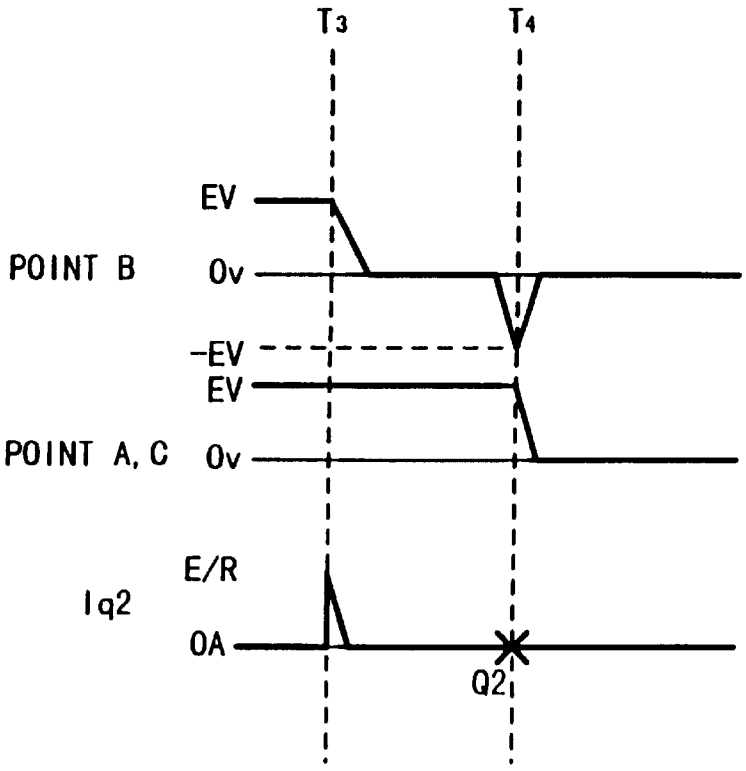
Fig. 9(B) Related Art
FIGS. 9A and 9B show signal waveforms when the ink-jet head is driven by the conventional circuit.
Figure 9A:
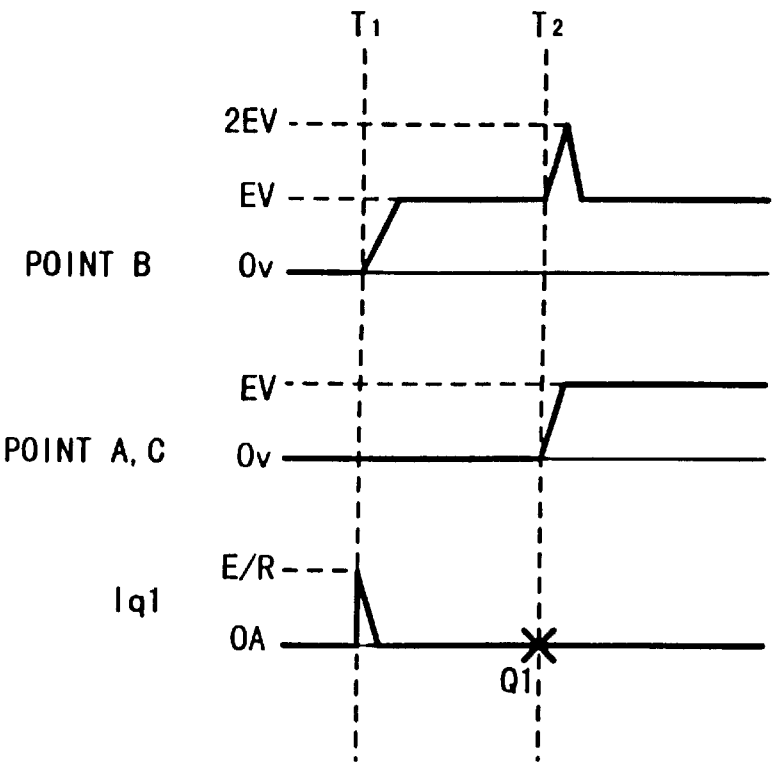
Fig. 9(A) Related Art

In the preferred embodiment, when a driving circuit such as shown in FIG. 8 is used, since the adjacent channel is driven while the transistor Q1 is turned ON (T1 of FIG. 9(A)), E (volts) is applied to the electrodes 13C1 and 13C2 between T1 and T2 in FIG. 9(A). At T2, the transistor Q3 is turned ON and at point C transitions from the "L" level to the "H" level (E(volts)). Accordingly, because the potential at point C becomes E (volts), the potential of each of the electrodes 13B1 and 13B2 becomes E (volts). Therefore, the potential of the electrode 13B2 is higher by E (volts) than that of the ground. Consequently, the potential of the electrode 13C1 becomes 2×E (volts) with reference to the ground, and a voltage of 2×E−E=E (volts) is applied across the transistor Q1. Therefore, a problem arises in that a through current caused by the voltage E (volts) breaks down the transistor Q1, which is a switching device for the electrodes 13C1 and 13C2 connected to the point B.

Further, when the potential at the point B is at the "H" level (E(volts)), namely, when E (volts) is applied to the electrodes 13C1 and 13C2, if the potential at the point A increases from the "L" level (0(volts)) to the "H" level (E(volts)), the potential of each of the electrodes 13D1 and 13D2 increases to the potential E (volts). Since the potential of the electrode 13D1 is higher by E (volts) than that of the ground and the potential of the electrode 13C2 is higher by E (volts) than that of the electrode 13D1, the potential of the electrode 13C2 is 2×E (volts) with reference to the ground. Accordingly, a voltage 2×E−E=E (volts) is applied at the collector across the collector-base junction of transistor Q1. Therefore, in the same manner as the foregoing, a problem arises in that a through current caused by the voltage E (volts) breaks down the transistor Q1, which is a switching device for the electrodes 13C1 and 13C2 connected to the point B.

On the other hand, when the potential at the point B is at the "L" level (0(volts)), between T3 and T4 in FIG. 9(B), namely, when the base ON current is applied to the base B2 of the transistor Q2 from a controller (not illustrated), a collector current Iq2 runs through the transistor Q2. Then, the potential at the point B connected to the collector C2 of the transistor Q2 through the resistor R1 is at the "L" level (0 (volts)) and the potential of each of the electrodes 13C1 and 13C2 is 0 (volts). In this state, if the potential at the point C is at the "H" level (E(volts)), the potential of each of the electrodes 13B1 and 13B2 is E (volts). Then, when the transistor Q4 of the driving circuit 14B is turned ON, the potential at the point C decreases from the "H" level (E(volts)) to the "L" level (0(volts)). At that moment, since the potential of the electrode 13C1 is still lower by E (volts) than that of the electrode 13B2, the potential of the electrode 13C1 is lower by E (volts) than that of the ground (at T4 in FIG. 9(B)).

Therefore, the potential at the point B is lower by E (volts) than that of the ground, and accordingly, a reverse bias voltage of −E (volts) is applied across the transistor Q2, breaking down the transistor Q2.

Further, when the potential at the point B is at the "L" level (0(volts)), between T3 and T4 in FIG. 9(B), namely, when the potential of each of the electrodes 13C1 and 13C2 is 0 (volts), if the potential at the point A is at the "H" level (E(volts)), the potential of each of the electrodes 13D1 and 13D2 is E (volts). Then, when the transistor Q6 of the driving circuit 14D is turned ON and the transistor Q5 is turned OFF, the potential at the point A decreases from the "H" level (E(volts)) to the "L" level (0(volts)). At that moment, since the potential of the electrode 13C2 is still lower by E (volts) than that of the electrode 13D1, the potential of the electrode 13C2 is lower by E (volts) than that of the ground (at T4 in FIG. 9(B)).

Therefore, the potential at the point B is lower by E (volts) than that of the ground, and accordingly, a reverse bias voltage of −E (volts) is applied across the transistor Q2, breaking down the transistor Q2.

In FIG. 9, a voltage drop across the transistors Q1 and Q2 when the transistors Q1 and Q2 are ON is assumed to be 0 volts.

FIG. 1 shows a circuit for driving the ink-jet head of the invention. As shown in FIG. 1, the channel wall 11A constituting a pressure-producing device is provided with the electrodes 13A2 and 13B1, the channel wall 11B constituting a pressure-producing device is provided with the electrodes 13B2 and 13C1, the channel wall 11C constituting a pressure-producing device is provided with the electrodes 13C2 and 13D1, and the channel wall 11D constituting a pressure-producing device is provided with the electrodes 13D2 and 13E1. The channel walls 11A, 11B, 1C, and 11D and their respective electrodes each form an equivalent electrostatic capacitor, $C_1$–$C_4$, respectively and these channel walls are connected in series through the electrodes 13B1, 13B2, 13C1, 13C2, 13D1, and 13D2.

In the driving circuit 14C, the transistor Q1 and the transistor Q2, which are the two switching devices, are connected in series between the power supply V (voltage E(volts)) and the ground. Here, the collector C1 of the transistor Q1 and the collector C2 of the transistor Q2 are connected at the connection point P1. One terminal of the resistor R1 (resistance R (Ω)) is connected at the connection point P1 and the other terminal of the resistor R1 is connected to the electrodes 13C1 and 13C2. The resistor R1 represents a resistance component of an impedance from the connection point made by the anode of a protection diode D1 and the cathode of a protection diode D2, which will be described later, to the electrodes 13C1 and 13C2. The resistance component is represented as one resistor R1 for convenience.

The transistor Q1 controls raising a voltage applied to the electrodes 13C1 and 13C2 (charging). The transistor Q2 controls lowering a voltage of the electrodes 13C1 and 13C2 (discharging). The transistor Q1 and the transistor Q2 are controlled by a selective ON current applied to each base B1 and B2, so that one of the transistors Q1 and Q2 is turned ON/OFF when the other is turned OFF/ON. Namely, when the ON signal current is applied to the base B1 of the transistor Q1, a current Iq1 runs through the collector C1 of the transistor Q1 and the transistor Q1 is turned ON. At that moment, the transistor Q2 is OFF. This switching control is conducted by a controller (not shown) that applies the ON signal current to the base B1 of the transistor Q1 and to the base B2 of the transistor Q2 selectively at a predetermined timing. When the transistor Q2 is turned ON, a current Iq2 runs through the collector C2 of the transistor Q2 to discharge charges at an electrostatic capacitance of C' from the electrode 13C1 and 13C2.

Further, the anode of the protection diode D1 is connected between the connection point P1 made by the transistor Q1 and the transistor Q2 and one terminal of the resistor R1, and the cathode of the protection diode D1 is connected to the power supply V so as to relieve the reverse bias voltage applied to the first transistor Q1 into the power supply V as a current Id1. Further, the cathode of the protection diode D2 is connected between the connection point P1 and one terminal of the resistor R1, and the anode of the protection diode D2 is connected to the ground so as to relieve the reverse bias voltage applied to the second transistor Q2 as a current Id2.

Further, as shown in FIG. 1, in the driving circuit 14B, a transistor Q3 and a transistor Q4, which are the two switching devices, are connected in series between the power supply V (voltage E(volts)) and the ground. Here, the collector C3 of the transistor Q3 and the collector C4 of the transistor Q4 are connected at the connection point P2. One terminal of the resistor R2 (resistance R(Ω)) is connected at the connection point P2 and the other terminal of the resistor R2 is connected to the electrodes 13B1 and 13B2. The resistor R2 represents a resistance component of an impedance from the connection point made by the anode of a protection diode D3 and the cathode of a protection diode D4, which will be described later, to the electrodes 13B1 and 13B2. The resistance component is represented as one resistor R2 for convenience.

The transistor Q3 controls raising a voltage applied to the electrodes 13B1 and 13B2 (charging). The transistor Q4 controls lowering a voltage of the electrodes 13B1 and 13B2 (discharging). The transistor Q3 and the transistor Q4 are controlled by a selective ON current applied to each base B3 and B4, respectively, so that one of the transistors Q3 and Q4 is turned ON/OFF when the other is turned OFF/ON. Thus, when the ON signal current is applied to the base B3 of the transistor Q3, a current Iq3 runs through the collector C3 of the transistor Q3 and the transistor Q3 is turned ON. At that moment, the transistor Q4 is OFF. This switching control is conducted by a controller (not illustrated) that applies the ON signal current to the base B3 of the transistor Q3 and to the base B4 of the transistor Q4 selectively, at a predetermined timing.

When the second transistor Q4 is turned ON, a current Iq4 runs through the collector C4 of the transistor Q4 to discharge charges at an electrostatic capacitance of C' (farads) from the electrodes 13B1 and 13B2.

The anode of the protection diode D3 is connected between the connection point P2 made by the transistor Q3 and the transistor Q4 and one terminal of the resistor R2. The cathode of the protection diode D3 is connected to the power supply V so as to relieve the reverse bias voltage applied to the first transistor Q3 into the power supply V as a current Id3. The cathode of the protection diode D4 is connected between the connection point P2 and one terminal of the resistor R2, and the anode of the protection diode D4 is connected to the ground so as to relieve the reverse bias voltage applied to the transistor Q4 as a current Id4.

Further, as shown in FIG. 1, in the driving circuit 14D, the transistor Q5 and the transistor Q6, which are the two switching devices, are connected in series between the power supply V (voltage E(volts)) and the ground. Here, the collector C5 of the first transistor Q5 and the collector C6 of the second transistor Q6 are connected at the connection point P3, and one terminal of the resistor R3 (resistance R(Ω)) is connected at the connection point P3 and the other terminal of the resistor R3 is connected to the electrodes 13D1 and 13D2. The resistor R3 represents a resistance component of an impedance from the connection point made by the anode of a protection diode D5 and the cathode of a protection diode D6, which will be described later, to the electrodes 13D1 and 13D2. The resistance component is represented as one resistor R3 for convenience.

The transistor Q5 controls raising a voltage applied to the electrodes 13D1 and 13D2 (charging). The transistor Q6 controls lowering a voltage of the electrodes 13D1 and 13D2 (discharging). The transistor Q5 and the transistor Q6 are controlled by a selective ON current applied to each base B5 and B6, respectively, so that one of the transistors Q5 and Q6 is turned ON/OFF when the other is turned OFF/ON. Thus, when the ON signal current is applied to the base B5 of the transistor Q5, a current Iq5 runs through the collector C5 of the transistor Q5 and the transistor Q5 is turned ON. At that moment, the transistor Q6 is OFF. This switching control is conducted by the controller (not shown) that applies the ON signal current to the base B5 of the transistor Q5 and to the base B6 of the transistor Q6 selectively at a predetermined timing.

When the transistor Q6 is turned ON, a current Iq6 runs through the collector C6 of the transistor Q6 to discharge charges at an electrostatic capacitance of C' from the electrodes 13D1 and 13D2.

The anode of the protection diode D5 is connected between the connection point P3 made by the transistor Q5 and the transistor Q6 and one terminal of the resistor R3. The cathode of the protection diode D5 is connected to the power supply V so as to relieve the reverse bias voltage applied to the first transistor Q5 into the power supply V as a current Id5. The cathode of the protection diode D6 is connected between the connection point P3 and one terminal of the resistor R3, and the anode of the protection diode D6 is connected to the ground so as to relieve the reverse bias voltage applied to the second transistor Q6 as a current Id6.

Other electrodes 13A1, 13A2, 13E1, 13E2, 13F1, and 13F2 are also provided with driving circuits and protection diodes as described above, respectively.

Next, the operation of the driving circuit according to the embodiment will be described with reference to FIG. 1 and FIG. 2.

Figure 2B:
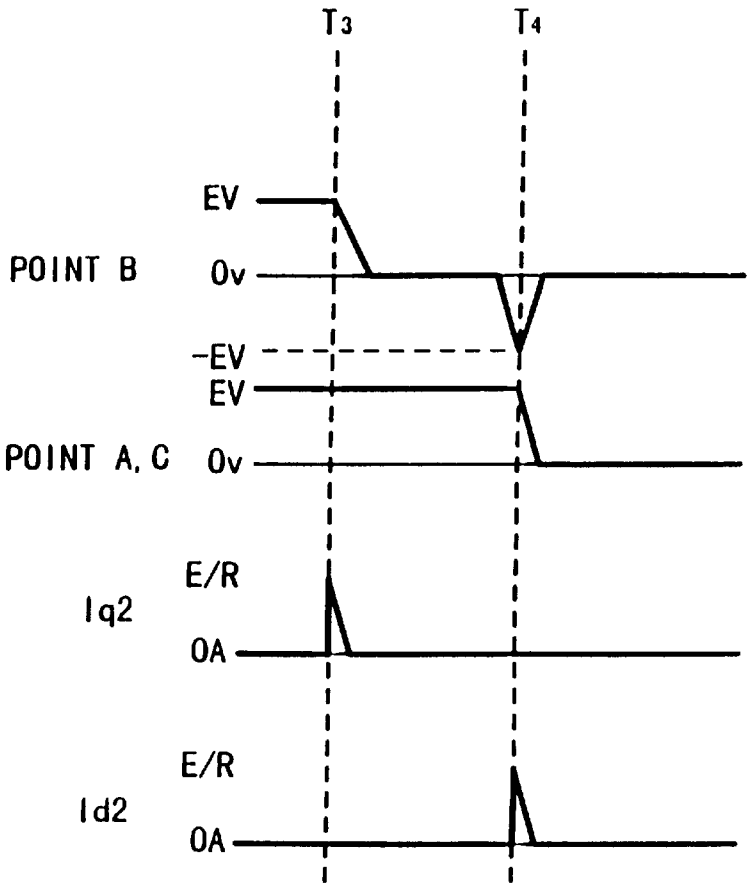
FIGS. 2A and 2B show signal waveforms when the ink-jet head is driven by the driving circuit of the invention.
Figure 2A:
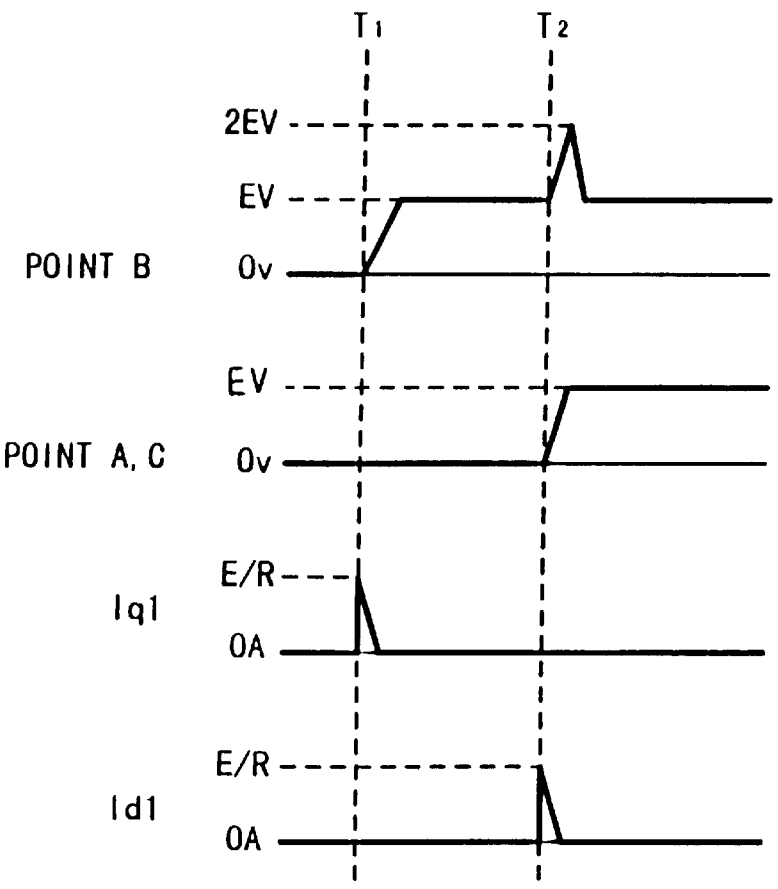
Figure 3:
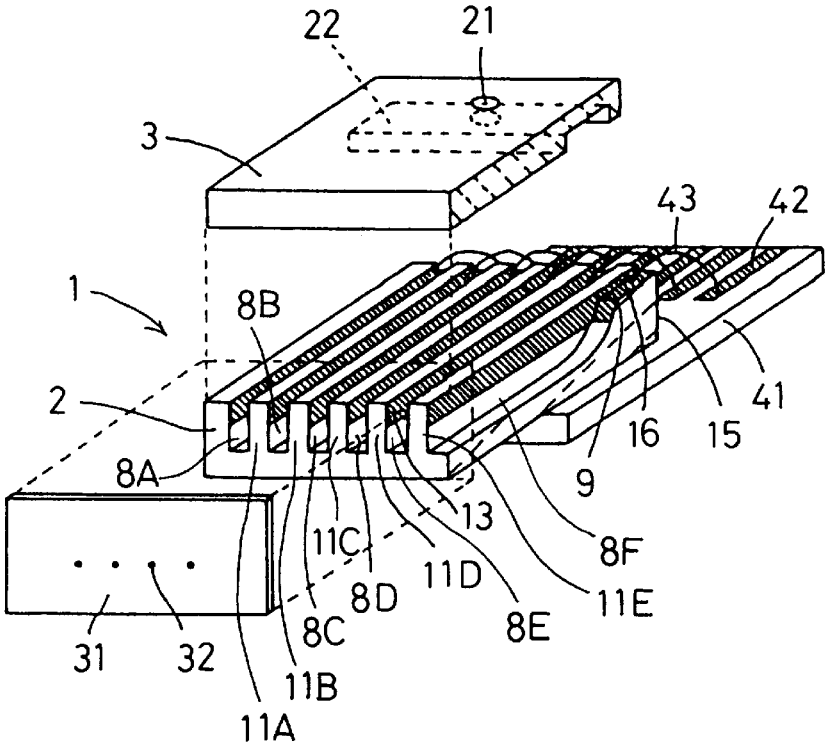
Fig.3 RELATED ART
FIG. 3 is a sectional perspective view of a part of the ink-jet head.
Figure 4:
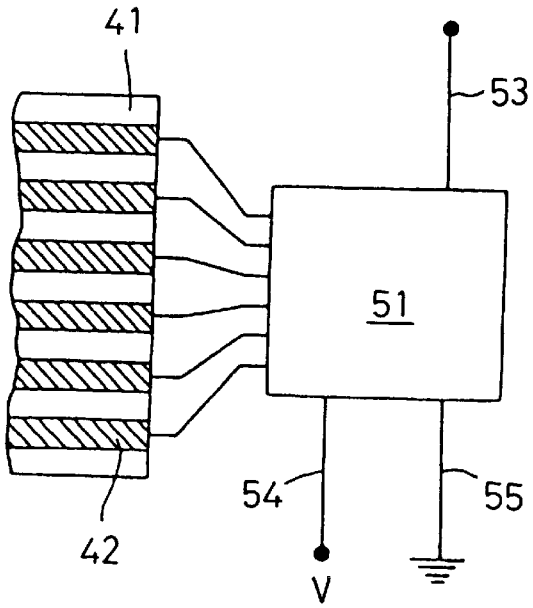
Fig.4 RELATED ART
FIG. 4 shows the relationship between a head driver and the conductive patterns.

When the controller (not shown) feeds the ON current to the base B1 of the transistor Q1, and with the transistor Q2 OFF (at T1 in FIG. 2(A)), the collector current Iq1 runs through the transistor Q1, the potential at the point B connected to the collector C1 of the transistor Q1 through the resistor R1 reaches the "H" level (E(volts)), and E (volts) is applied to the electrodes 13C1 and 13C2 (state between T1 and T2 in FIG. 2(A)). Here, by expressing an electrostatic capacitance of the condenser $C_2$ composed by the electrodes 13B2 and 13C1 and the channel wall 11B as C' (farads), and the quantity of charges contained in the electrode 13C1 as $Q_1$, $Q_1$=C'×E (coulombs) is given. Further, by expressing an electrostatic capacitance of the condenser $C_3$ composed by the electrodes 13C2 and 13D1 and the channel wall 11C as C' (farads), and the quantity of charges contained in the electrode 13C2 as $Q_2$, $Q_2$=C'×E (coulomb) is given. Therefore, the sum Q of the charges contained in the electrodes 13C1 and 13C2 is:

$$Q=Q_1+Q_2=C'\times E+C'\times E=2\times C'\times E\text{(coulomb)}.$$

With the potential at the point B at the "H" level, if the potential at the point C increases from the "L" level (0(volts)) to the "H" level (E(volts)) at T2 in FIG. 2(A), the potential of each of the electrodes 13B1 and 13B2 becomes E (volts). Therefore, the potential of the electrode 13B2 is higher by E (volts) than that of the ground, the potential of the electrode 13C1 is higher by E (volts) than that of the electrode 13B2. Consequently, the potential of the electrode 13C1 becomes 2×E (volts) with reference to the ground, and a reverse bias voltage of 2×E−E=E (volts) is applied to the transistor Q1. However, the protection diode D1 relieves the reverse bias voltage.

Further, when the potential at the point B is at the "H" level, namely, when E (volts) is applied to the electrodes 13C1 and 13C2, if the potential at the point A increases from the "L" level (0(volts)) to the "H" level (E(volts)), the potential of each of the electrodes 13D1 and 13D2 becomes E (volts). Therefore, the potential of the electrode 13D1 is higher by E (volts) than that of the ground, the potential of the electrode 13C2 is higher by E (volts) than that of the electrode 13D1. Consequently, the potential of the electrode 13C2 becomes 2×E (volts) with reference to the ground, and a reverse bias voltage of 2×E−E=E (volts) is applied to the transistor Q1. However, the protection diode D1 relieves the reverse bias voltage.

At this moment, since the sum of the charges Q contained in the channel walls 11B and 11C is 2×C'×E (coulomb), by expressing the current running through the protection diode D1 as Id1, $$Id\mathbf{1}=(d/dt)(2\times C'\times E)\ \text{(amps)}$$

is given.

Here, when the maximum printing frequency is expressed as f(Hz), f is a frequency per unit time and d/dt can be replaced by f, and accordingly, $$Id\mathbf{1}=2\times f\times C'\times E\ \text{(amps)} \qquad \text{(equation 1)}$$

is given.

On the other hand, when the potential at the point B is at the "L" level (0(volts)), between T3 and T4 in FIG. 2(B), namely, when the controller (not illustrated) feeds the ON current to the base B2 of the transistor Q2, the collector current Iq2 runs through the transistor Q2. When the potential at the point B connected to the collector C2 of the transistor Q2 through the resistor R1 is at the "L" level (0(volts)), the potential of the electrodes 13C1 and 13C2 is 0 (volts). In that state, if the potential at the point C is at the "H" level (E(volts)), the potential of each of the electrodes 13B1 and 13B2 is E (volts).

By expressing an electrostatic capacitance of the condenser C2 composed of the electrodes 13B2 and 13C1 and the channel wall 11B as C' (farads), and the quantity of charges contained in the electrode 13C1 as $Q_1$, $Q_1=-C'\times E$ (coulomb) is given. Further, by expressing an electrostatic capacitance of the condenser $C_3$ composed by the electrodes 13C2 and 13D1 and the channel wall 11C as C' (farads), and the quantity of charges contained in the electrode 13C2 as $Q_2$, $Q_2=-C'\times E$ (coulomb) is given. Therefore, the sum Q of the charges contained in the electrodes 13C1 and 13C2 is:

$$Q=Q_1+Q_2=(-C'\times E)+(-C'\times E)=-2\times C'\times E\,\text{(coulomb)}.$$

When the transistor Q4 in the driving circuit 14B is turned ON, the potential at the point C decreases from the "H" level (E(volts)) to the "L" level (0(volts)). Since, at that moment, the potential of the electrode 13C1 is still lower by E (volts) than that of the electrode 13B2, the potential of the electrode 13C1 is lower by −E (volts) than that of the ground (T4 in FIG. 2(B)).

Therefore, the potential at the point B is lower by −E (volts) than that of the ground, and a reverse bias voltage of −E (volts) is applied to the transistor Q2. However, the protection diode D2 relieves the reverse bias voltage.

At this moment, since the sum of the charges Q contained in the channel walls 11B and 11C is −2×C'×E (coulomb), by expressing the current running through the protection diode D2 as Id2, which runs in the reverse direction to Id1, $$-Id\mathbf{2}=(d/dt)(-2\times C'\times E)\ \text{(amps)},$$

or $$Id\mathbf{2}=(d/dt)(2\times C'\times E)\ \text{(amps)}$$

is given.

Here, when the maximum printing frequency is expressed as f (Hz), f is a frequency per unit time and d/dt can be replaced by f, and accordingly, $$Id\mathbf{2}=2\times f\times C'\times E\ \text{(amps)} \qquad \text{(equation 2)}$$

is given.

Therefore, in each case of the foregoing, as shown by the equations 1 and 2, the average rectified current $I_0$ in the maximum rating of the foregoing protection diodes D1 and D2 must satisfy the following equation, for the protection diodes not to break down under an excessive discharge current.

$$I_0\geqq 2\times E\times C'\times f\ \text{(amps)} \qquad \text{(equation 3)}$$

where,

E: power supply voltage (volts)

C': electrostatic capacitance of the pressure-producing device (farads)

f: maximum printing frequency (Hz).

Therefore, the circuit for driving an ink-jet head of this embodiment employs the protection diodes D1 and D2 that satisfy equation 3.

Next, the maximum rating of the peak current relating to the protection diodes D1 and D2 will be described. As can be seen from the foregoing descriptions, in the driving circuit shown in FIG. 1, when the transistor Q1 is turned ON, the transistor Q2 is turned OFF, the transistor Q3 is turned OFF, and the transistor Q4 is turned ON, the potential of the electrode 13C1 is E (volts) and the potential of the electrode 13B2 is 0 (volts). Thus, the potential of the electrode 13C1 is higher by E (volts) than that of the electrode 13B2. Then, when the transistor Q3 is turned ON and the transistor Q4 is turned OFF, the potential of the electrode 13B2 increases to E (volts), and the potential of the electrode 13C1 increases to 2×E (volts). Therefore, a reverse bias voltage of 2×E−E=E (volts) is applied to the transistor Q1. However, since the protection diode D1 is connected, the current Id1 runs through the protection diode D1. The current Id1 runs through a closed circuit formed by the power supply V of the driving circuit 14B, transistor Q3, connection point P2, resistor R2, point C, electrode 13B2, electrode 13C1, point B, resistor R1, protection diode D1, and the power supply V of the driving circuit 14C (here, an emitter current and the collector current of the transistor Q3 are approximately equal, since the base current of the transistor Q3 is minute).

By expressing the ON resistance of the transistor Q3 as $R_{ON}$ (Ω), the resistance of each of the resistors R1 and R2 as R (Ω), and the forward voltage drop of the protection diode D1 as $E_F$ (volts), the following relation is given according to the Kirchhoff's law and Ohm's law:

$$0 = -Id1 \times R_{ON} - Id1 \times R + E - Id1 \times R - E_F$$
$$= -Id1 \times (2 \times R + R_{ON}) + E - E_F,$$

therefore, $$Id1=(E-E_F)/(2\times R+R_{ON}) \quad \text{(equation 4)}$$

With respect to the electrode 13C2, a closed circuit is formed by the power supply V of the driving circuit 14D, transistor Q5, connection point P3, resistor R3, point A, electrode 13D1, electrode 13C2, resistor R1 protection diode D1, and the power supply V of the driving circuit 14C. In the same manner as the above, by expressing the ON resistance of the transistor Q5 as $R_{ON}$ (Ω), the resistance of each of the resistors R3 and R2 as R (Ω), and the forward voltage drop of the protection diode D1 as $E_F$ (volts), the following relation is given according to the Kirchhoff's law and Ohm's law:

$$0 = -Id1 \times R_{ON} - Id1 \times R + E - Id1 \times R - E_F$$
$$= -Id1(2 \times R + R_{ON}) + E - E_F,$$

therefore, $$Id1=(E-E_F)/(2\times R+R_{ON}) \text{ (amps)} \quad \text{(equation 5)}$$

As clearly seen from equations 4 and 5, the current $(E-E_F)/(2\times R+R_{ON})$ (amps) from the electrode 13C1 runs through the diode D1, and the current $(E-E_F)/(2\times R+R_{ON})$ (amps) from the electrode 13C2 runs through the diode D2. Therefore, the total current $$I_{FM} \geqq 2\times(E-E_F)/(2\times R+R_{ON}) \text{ (amps)} \quad \text{(equation 6)}$$

is given.

For the protection diode D2, in the same manner as the above, according to the Kirchhoff's law and Ohm's law, the total current is:

$$I_{FM}=2\times(E-E_F)/(2\times R+R_{ON}) \text{ (amps)} \quad \text{(equation 7)}$$

Therefore, in order to prevent a breakdown of the protection diodes D1 and D2 from an excessive peak current, $I_{FM}$ must satisfy the following relationship where the peak current in the maximum rating of each of the protection diodes D1 and D2 is expressed as $I_{FM}$ (amps):

$$I_{FM} \geqq 2\ (E-E_F)/(2\times R+R_{ON}) \text{ (amps)} \quad \text{(equation 8)}$$

where,

E: power supply voltage (volts)

$E_F$: forward voltage drop of the protection diode (volts)

R: resistance of the impedance of the driving circuit from the connection point made by the anode of the protection diode D1 and the cathode of the protection circuit D2 to the electrodes 13C1 and 13C2 (Q)

$R_{ON}$: ON resistance of the transistor (Ω).

Therefore, the circuit for driving the ink-jet head of this embodiment employs the protection diodes D1 and D2 that satisfy equation 8.

As shown in FIG. 2, if the current Iq1 runs through the transistor Q1, the potential at the point B increases to the "H" level (E(volts)) between T1 and T2 in FIG. 2(A). The potential at each of the points A and C that sandwich the point B increases from the "L" level to the "H" level at T2 in FIG. 2(A) and the potential at the point B will become excessively high (2×E(volts)). However, the current Id1 runs through the protection diode D1. Consequently, the transistor Q1, which is the switching device for the point B, can be protected from breaking down.

On the other hand, if the potential at each of the points A and C decreases from the "H" level (E(volts)) to the "L" level (0(volts)) in a state that the potential at the point B is at the "L" level (0 (volts)), the potential at the point B will become excessively low (−E(volts)). However, the current Id2 runs through the protection diode D2 to protect the transistor Q2 from breaking down. Further, in FIG. 2, a voltage drop when the transistors Q1 and Q2 are ON is assumed to be 0 volts, in the same manner as in FIG. 9.

In the foregoing embodiment, the average rectified current $I_0$ used in the maximum rating of each of the protection diodes D1 and D2 is:

$$I_0 \geqq 2\times E\times C'\times f \text{ (amps)},$$

and the peak current $I_{FM}$ used in the maximum rating of each of the protection diodes D1 and D2 is:

$$I_{FM} \geqq 2\times(E-E_F)/(2\times R+R_{ON}) \text{ (amps)},$$

and therefore, the protection diodes relieve the reverse bias voltages and will not be broken down by the currents running through the diodes.

Therefore, the circuit for driving an ink-jet head will not malfunction with repeated printing operations.

What is claimed is:

1. A driving circuit, electrically connected between a voltage source and an ink-jet head, for driving the ink-jet head comprising:

a plurality of ink-jet channels made in a continuous shape; and actuators provided between the plurality of channels, and electrically connected to the voltage source, so as to pressurize ink in the channels, wherein when ink is jetted sequentially from adjacent channels among the plurality of channels, a drive voltage from the voltage source is applied to the actuator between the adjacent channels so that the actuator is deformed to pressure ink in one of the adjacent channels, and then another drive voltage is applied to the actuator so that the actuator returns to its original state and pressurizes ink in the other channel, wherein the driving circuit applies the drive voltage to the actuators on both sides of the channel from which ink is jetted, and the ink in the channel is pressurized by driving the actuators on both sides of the channel, the driving circuit applies the drive voltage for jetting ink from a first channel, the drive voltage being applied for a first duration and then the driving circuit applies another drive voltage for a second duration for jetting ink from an adjacent channel in such a manner that the first duration partially overlaps the second duration.

2. The driving circuit for driving an ink-jet head as claimed in claim 1, wherein the actuators are channel walls provided between the plurality of channels such that the channel walls form the plurality of channels.

3. The driving circuit for driving an ink-jet head as claimed in claim 2, wherein at least one part of each channel wall is formed by a polarized piezoelectric material, and an electrode is provided on either channel-facing side of the polarized piezoelectric material to generate drive fields perpendicular to the polarized direction.

4. The driving circuit for driving an ink-jet head as claimed in claim 1, wherein:

two switching devices are connected in series between the voltage source and a ground, and a connection point made by the two switching devices is connected to the electrodes so that one of the two switching devices serves to raise the drive voltage applied to the electrodes, and the other switching device serves to lower the drive voltage applied thereto;

protection diodes for protecting the switching devices from a reverse bias voltage are connected in parallel with the respective switching devices; and an average rectified current $I_0$ used in the maximum rating of the protection diodes satisfies the following equation:

$$I_0 \geqq E \times C' \times F > 2 \text{ (amps)},$$

where,

E: a power supply voltage (volts)

C': an electrostatic capacitance of the channel wall (farads)

f: a maximum printing frequency (Hz).

5. The driving circuit for driving an ink-jet head as claimed in claim 1, wherein the channels are divided into a plurality of groups so that adjacent channels belong to different groups, and the drive voltage is applied group by group.

6. A circuit for driving adjacent ink-jet channels, in a sequential, overlapped manner, of an ink-jet head which comprises a plurality of ink-jet channels made in a continuous shape, actuators consisting of pressure-producing devices provided in correspondence with the channels, nozzles provided in correspondence with the channels and electrodes for applying a drive voltage from a power supply to the pressure-producing devices, and which generates pressure variations inside the channels to jet ink from the nozzles when the drive voltage is applied to the electrodes of the actuators, wherein two switching devices for each ink jet channel of the plurality of ink iet channels are connected in series between the power supply and a ground, and a connection point made by the two switching devices is connected to the electrodes on actuators opposing an ink jet channel so that one of the two switching devices serves to raise the drive voltage applied to the electrodes and the other switching device serves to lower the drive voltage applied thereto, protection diodes for protecting the switching devices from a reverse bias voltage are connected in parallel with the respective switching devices when an adjacent ink-jet channel is driven in the sequential, overlapped manner, and an average rectified current $I_0$ used in the maximum rating of the protection diodes satisfies the following equation:

$$I_0 \geqq E \times C' \times f \times 2 \text{ (amps)},$$

where,

E: a power supply voltage (volts)

C': electrostatic capacitances of the pressure-producing devices (farads)

f: maximum printing frequency (Hz).

7. The circuit for driving an ink-jet head as claimed in claim 6, wherein a peak current $I_{FM}$ used in the maximum rating of the protection diodes satisfies the following equation:

$$I_{FM} \geqq 2 \times (E - E_F)/(2 \times R + R_{ON}) \text{ (amps)}$$

where,

E: the power supply voltage (volts)

$E_F$: a forward voltage drop of the protection diodes (volts)

R: a resistance of an impedance of the circuit from the connection point made by the protection diodes to the electrodes (Ω)

$R_{ON}$: an ON resistance of the switching devices (Ω).

8. The circuit for driving an ink-jet head as claimed in claim 6, wherein the pressure producing devices are channel walls.

9. The circuit for driving an ink-jet head as claimed in claim 8, wherein the channels are formed dividedly in a continuous shape on a piezoelectric board; and the channel walls are deformed through the application of the drive voltage to the electrodes to change the channel volume and accordingly to jet ink.

10. A method for driving an ink-jet head, comprising:

deforming an actuator in a first direction to jet ink from a first channel; and deforming the actuator in a second direction to jet ink from a second channel adjacent to the first channel in an overlapping manner while the actuator is deformed in the first direction, the actuator between the first channel and second channel;

applying a voltage from a power supply to the actuator to produce the steps of deforming the actuator in the first direction and deforming the actuator in the second direction;

raising the voltage to electrodes of a pair of actuators defining the first channel therebetween using a first switching device and lowering the voltage to the electrodes using a second switching device; and preventing a reverse current from being applied to the first switching device and the second switching device.

11. The method for driving an ink-jet head according to claim 10, wherein the first and the second switching devices are connected in series between the power supply and a ground and a connection point made by the first and the second switching devices is connected to electrodes of the actuator.

12. The method for driving an ink-jet head according to claim 10, wherein the voltage for jetting ink from the first channel is applied for a first duration and the voltage for jetting ink from the second channel is applied for a second duration, the second duration overlapping a latter half of the first duration.

13. The method for driving the ink-jet head according to claim 10, wherein the actuator is a channel wall.

14. The method for driving an ink-jet head according to claim 13, further comprising applying the voltage to two channel walls of a channel from which ink is to be jetted, thereby pressurizing ink by deforming two sides of the channel.

* * * * *